US005372506A

United States Patent [19]

Hambright

[11] Patent Number: 5,372,506

[45] Date of Patent: Dec. 13, 1994

[54] DRAW-THROUGH-PATTERN GRAPHICS SYSTEM

[76] Inventor: Perry Hambright, 22543 Ventura Blvd., Suite 211, Woodland Hills, Calif. 91364

[21] Appl. No.: 147,735

[22] Filed: Nov. 4, 1993

[51] Int. Cl.[5] ..... B41L 13/02; B41F 15/36

[52] U.S. Cl. ..... 434/84; 434/88; 101/114; 101/126; 101/127.1; 101/129

[58] Field of Search ..... 101/114, 127, 127.1, 101/128, 128.1, 126, 129, 474; 38/102.2, 102.91; 434/84, 87, 88, 90

[56] References Cited

U.S. PATENT DOCUMENTS

| | | | |
|---|---|---|---|
| 325,041 | 8/1985 | Bendick | 101/127 |
| 2,718,190 | 9/1955 | Bean | 101/127 |
| 3,244,093 | 4/1966 | Vasilantone | 101/126 |
| 3,457,625 | 7/1969 | Wanamaker | 29/407 |
| 4,023,524 | 5/1977 | Goldfarb et al. | 101/114 |
| 4,355,722 | 10/1982 | Lemmeyer | 206/575 |
| 4,564,406 | 1/1986 | Binks | 156/63 |
| 4,569,283 | 2/1986 | Sato et al. | 101/114 |
| 4,634,616 | 1/1987 | Musante et al. | 428/40 |
| 4,852,483 | 8/1989 | Bussard | 101/128 |
| 4,998,471 | 3/1991 | Harrington | 101/126 |
| 5,014,614 | 5/1991 | Thieme | 101/128.1 |
| 5,096,422 | 3/1992 | Hambright | 434/95 |
| 5,144,899 | 9/1992 | Allen | 101/11.4 |
| 5,165,337 | 11/1992 | Schlundt | 101/114 |
| 5,263,862 | 11/1993 | Claytor | 434/88 |

*Primary Examiner*—Edgar S. Burr
*Assistant Examiner*—Stephen R. Funk
*Attorney, Agent, or Firm*—Kelly, Bauersfield & Lowry

[57] ABSTRACT

A process for painting a design onto a clothing item to create wearable art utilizes a draw-through-pattern graphics system. When creating wearable art on a clothing item such as a shirt, a backing board is placed within the shirt so as to underlie the shirt fabric to which the design will be applied. A bracket is placed over the shirt and engages a peripheral portion of the backing board in a manner causing the shirt fabric to be stretched over the backing board and to clamp a portion of the shirt between the bracket and the backing board. A screen pattern bearing a printed outline pattern thereon is removably placed in register within the bracket. Fabric markers or fine-tipped fabric paint bottles are utilized to apply a fabric paint or like substance through the screen pattern onto the underlying portion of the shirt to recreate the printed pattern. The screen pattern may be removed from the bracket to check on progress of creation of the wearable art, and replaced without any misalignment between the printed pattern and the previously painted portions of the wearable art design. When completed, the graphics system is disassembled and removed from the shirt.

22 Claims, 4 Drawing Sheets

FIG. 1
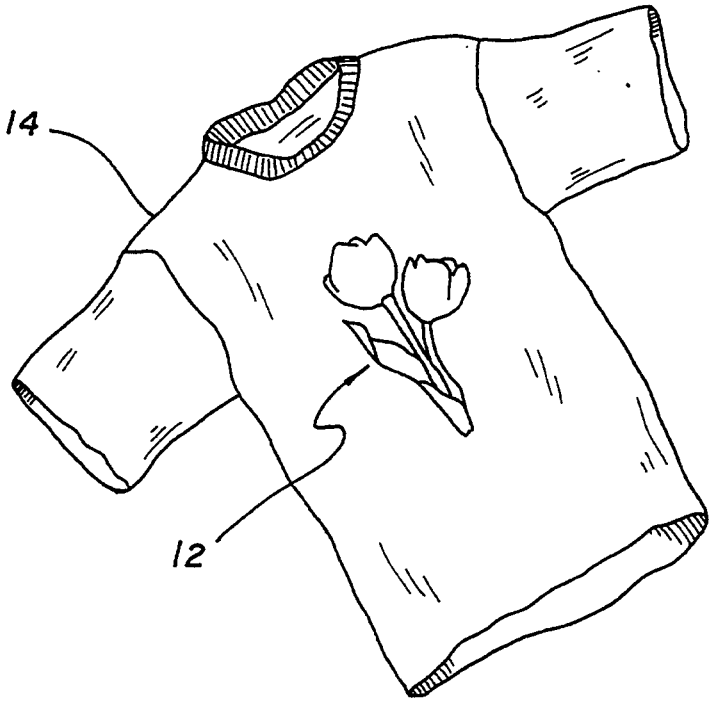
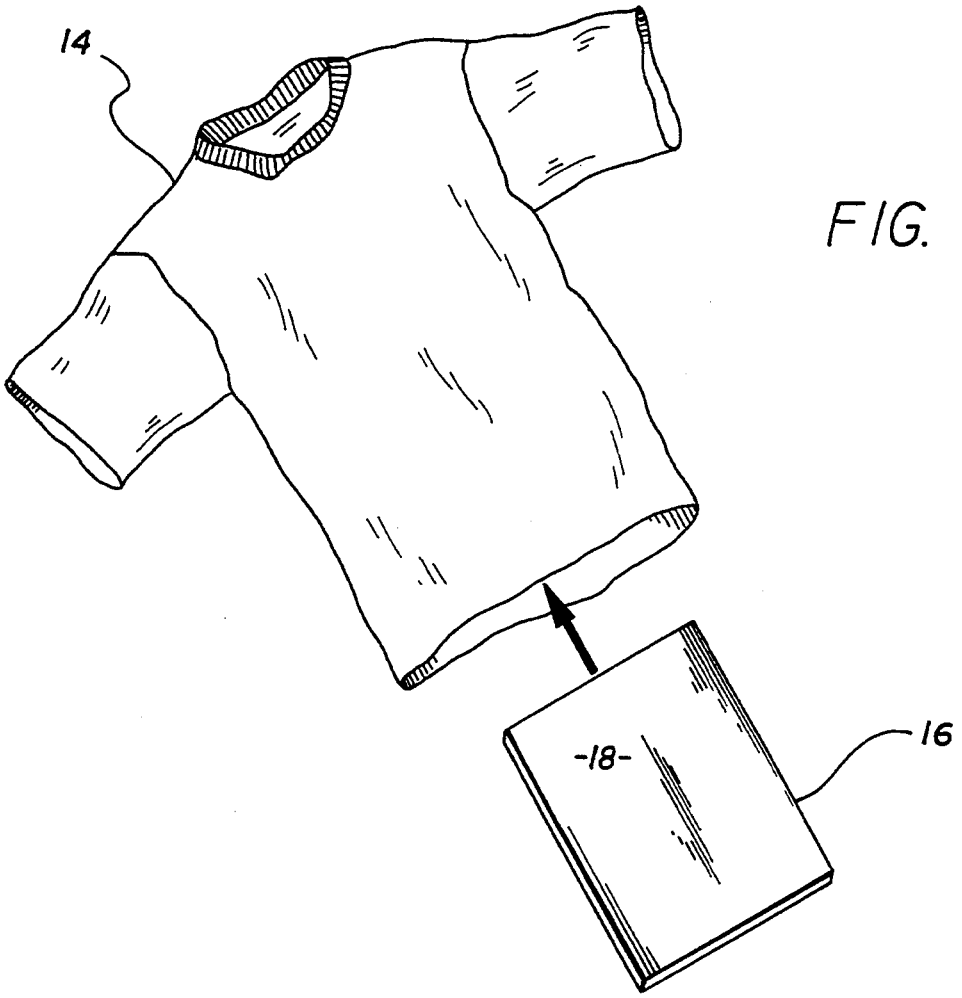
FIG. 2

DRAW-THROUGH-PATTERN GRAPHICS SYSTEM

BACKGROUND OF THE INVENTION

This invention relates generally to handicrafts. More specifically, the present invention relates to a method for applying a design to a substrate, and a related draw-through-pattern graphics system.

One of the most popular craft categories is that of "wearable art". Wearable art includes a wide variety of designs applied to items of clothing. In addition to mass-produced wearable art clothing items, there are a number of handicrafts kits on the market which permit crafters to create their own wearable art on virtually any type of clothing item. For example, handicrafts kits are available for applying sequins and like items to a layer of fabric, as shown in U.S. Pat. No. 5,096,422.

One of the most popular types of wearable art involves painted designs applied to T-shirts, sweats, jackets and other clothing items. Typically, an iron-on outlined design is applied to the clothing item, and then a fabric paint or fabric marker is utilized to fill-in the outline. Although this process appears, at first, to be simple, iron-on transfer units can be difficult to get completely transferred. Moreover, loose clothing fabric can be difficult to paint or mark unless it is stretched properly over a flat surface. Although fabric painting is very popular, another drawback is the mess. Fabric paints are messy and permanent. One must be very careful when applying fabric paint to a garment, being careful not to smudge it.

Accordingly, there has been a need for a portable draw-through-pattern graphics system, and a related method for applying a design to a substrate, which is inexpensive, easy to use, and provides good, reproducible results. Such a graphics system should permit children to make their own wearable art, and minimize the possibility of ruining an item of clothing by the misapplication of the fabric paint or marker. Moreover, such a graphics system should be relatively compact and portable, and include components which are reusable. The present invention fulfills these needs and provides other related advantages.

SUMMARY OF THE INVENTION

The present invention resides in a method for applying a design to a substrate, and a related portable draw-through-pattern graphics system. The graphics system comprises, generally, a rigid backing board having a generally planar supporting surface over which a substrate is draped. A screen pattern is disposed adjacent to the substrate opposite the supporting surface, and means are provided for clamping the substrate to the backing board, and for engaging edges of the screen pattern to limit movement of the screen pattern relative to the substrate. In the preferred embodiments the substrate is a portion of a clothing item, such as a T-shirt.

In one preferred form, the screen pattern includes an open mesh inner paint-through mesh screen having an outline design and color indicia imprinted thereon, which is stretched and affixed to a relatively rigid outer frame. The clamping means comprises a rigid bracket having an outer periphery generally corresponding with an outer periphery of the backing board. The bracket is pressed over the backing board to frictionally capture the substrate between the frame and the outer periphery of the backing board. The bracket includes an inner peripheral portion dimensioned to correspond to the dimensions of the screen pattern outer frame. The screen pattern outer frame includes notches which facilitate removal of the screen pattern from the bracket, when needed.

In another preferred form of the invention, the clamping means comprises a plurality of registration tabs which are disposed over the substrate opposite the rigid backing board. The registration tabs are held in place by push pins which extend through the registration tabs and the substrate into the backing board. When utilizing the push pins, it is preferred that the backing board comprise a rigid yet pierceable foam or fiber material.

The draw-through-pattern graphics system provides a novel method for applying a design to the substrate. In accordance with this method, the substrate is placed over the relatively rigid backing board, and the bracket is secured to the backing board over the substrate in a manner preventing relative movement between the bracket and the substrate. The screen pattern is placed over the substrate and within the bracket, and the design is then painted onto the substrate through the screen pattern. When the substrate is a portion of a clothing item, the backing board is placed within the clothing item such that a portion of the clothing item is stretched over the backing board as the bracket is clamped thereto.

During the step of securing the bracket to the backing board, the substrate is clamped between the bracket and the backing board so as to lock together the backing board, a portion of the substrate overlying the backing board, and the bracket. In the first preferred form of the invention, a rigid hoop-like bracket is provided which is dimensioned to generally match the outer peripheral dimensions of the backing board. The outer peripheral edges of the screen pattern are dimensioned to match the inner peripheral edges of the hoop-like bracket so that as the screen pattern is placed over the substrate within the bracket, the edges of the screen pattern engage the inner periphery of the bracket, in register, to limit movement of the screen pattern relative to the substrate. A fabric paint bottle is utilized to apply paint to the substrate through the screen pattern in accordance with the imprinted outline design and color indicia provided thereon. In the second preferred form of the invention, the registration tabs are utilized in place of the hoop-like bracket, and they are pinned to the backing board through the substrate.

The method of the present invention further includes the steps of removing the screen pattern from the substrate in order to check progress of the painting of the design onto the substrate through the screen pattern, and replacing the screen pattern over the substrate and within the bracket. This permits further painting of the design onto the substrate through the screen pattern, if needed, without loss of registration with previously painted areas.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a perspective view of a T-shirt having a wearable art design applied to a front portion thereof utilizing the graphics systems of the present invention;

FIGS. 2–7 illustrate a process for creating the wearable art on the clothing item shown in FIG. 1, wherein:

FIG. 2 illustrates the step of placing a backing board within the shirt so as to immediately underlie the portion of fabric to which the wearable art will be applied;

FIG. 3 illustrates the step of placing a rigid rectangular bracket over the shirt so as to capture a portion of the shirt fabric between the bracket and the backing board;

FIG. 4 illustrates the step of placing a screen pattern within the bracket over the portion of the shirt to which the wearable art is to be applied, in register with the bracket;

FIG. 5 illustrates the screen pattern in place within the bracket;

FIG. 6 is an enlarged, fragmented sectional view taken generally along the line 6—6 of FIG. 5, illustrating the manner in which a portion of the shirt is captured between the bracket and the backing board, the positioning of the screen pattern within the bracket over the shirt fabric, and the manner of applying paint through the screen pattern utilizing a fine-tipped fabric paint bottle;

FIG. 7 illustrates the step of removing the components of the graphics system from the shirt after the wearable art has been applied.

DETAILED DESCRIPTION OF THE PREFERRED EMBODIMENTS

Figure 8:
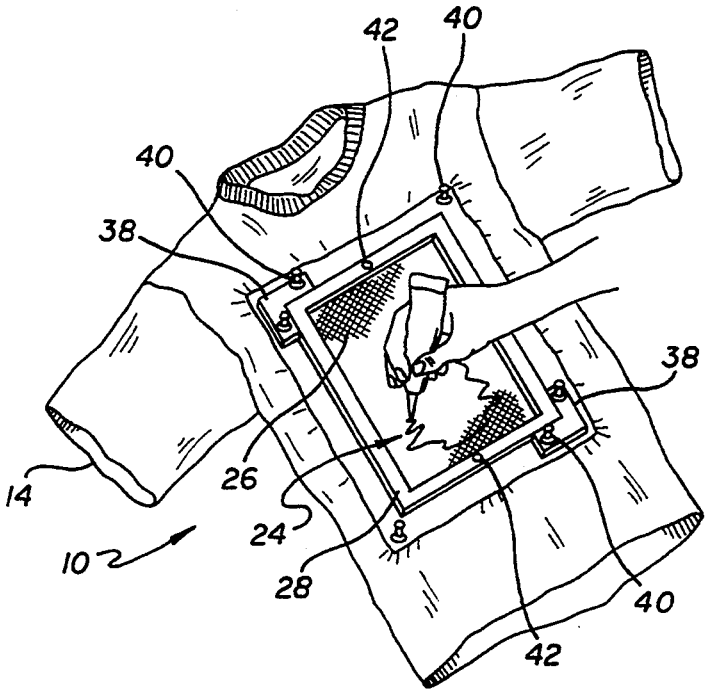
FIG. 8 illustrates another embodiment of the graphics system, wherein a pair of L-shaped registration tabs and several push pins are utilized instead of the bracket, to hold the shirt securely over the backing board and to provide means for placing and replacing the screen pattern in a precise position over the shirt and the backing board.
Figure 7:
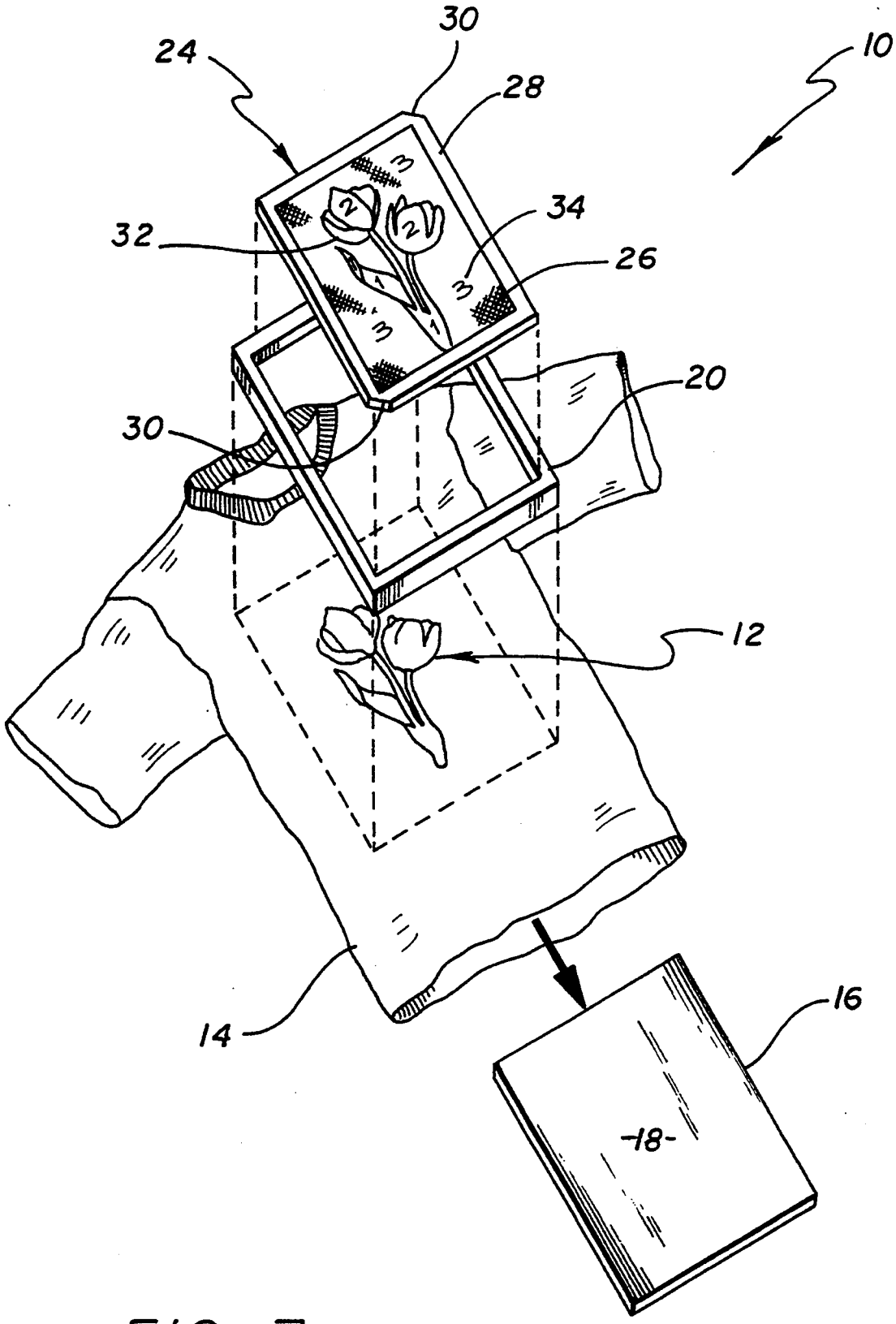

As shown in the drawings for purposes of illustration, the present invention is concerned with a draw-through-pattern graphics system, generally designated in FIGS. 7 and 8 by the reference number 10. The graphics system 10 is utilized to create wearable art 12 on a suitable substrate, such as a clothing item 14 (see FIG. 1).

In accordance with the present invention, the graphics system 10 comprises, generally, a backing board 16 having a flat surface 18 which generally underlies the portion of the clothing item 14 to which the wearable art 12 will be applied. A hoop-like bracket 20 having an inner periphery generally corresponding to the outer periphery of the backing board 16, is pressed over the clothing item 14 and secured to the backing board. The bracket 20 includes a large central aperture 22 into which a screen pattern 24 is placed. The screen pattern includes an inner paint-through mesh screen 26, and a relatively rigid outer frame 28. The frame 28 is provided with a pair of notches 30 which facilitate removal of the screen pattern 24 from the bracket 20. The mesh screen 26 of the screen pattern 24 may include a printed outline pattern 32 and printed color indicia 34 imprinted thereon, as shown.

With reference now to FIGS. 2–7, a method for applying a design to the shirt 14 will be described. First, the backing board 16 is placed inside the shirt 14 and positioned behind the location the wearable art 12 is to appear (FIG. 1). The bracket 20 is pressed onto the backing board from the outside of the shirt 14, sandwiching the shirt fabric between the bracket 20 and the backing board 16. The bracket 20 fits snugly over the fabric of the shirt 14 and stretches it flat over the surface 18 of the backing board 16 as it is clamped into place. This provides a smooth painting surface (see FIGS. 3 and 6).

Figure 3:
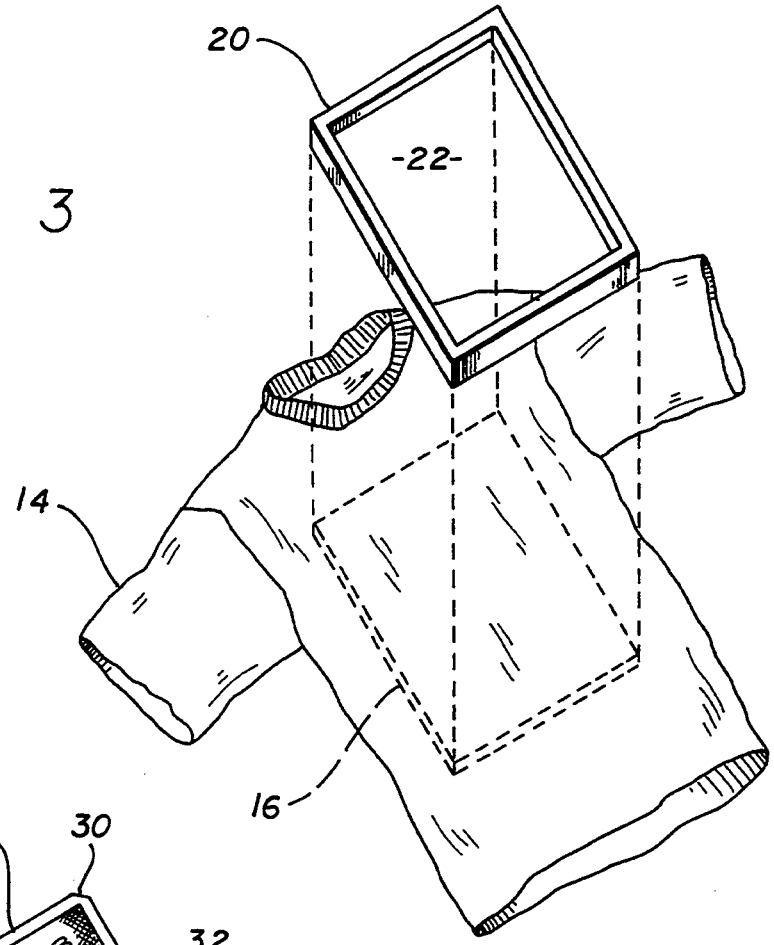
Figure 4:
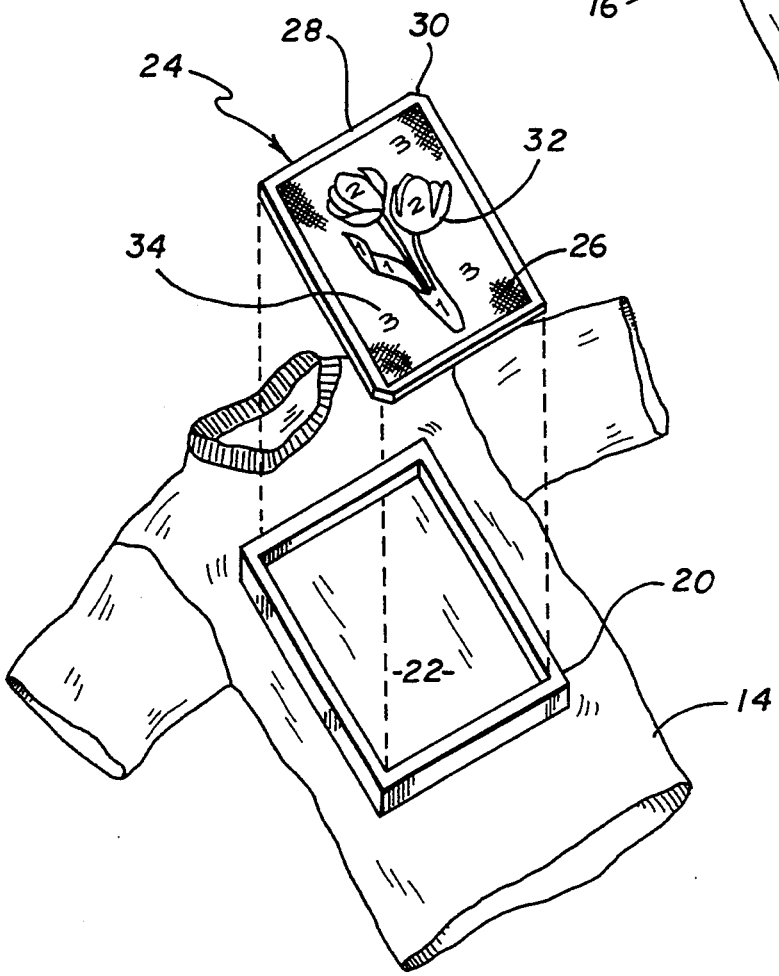
Figure 5:
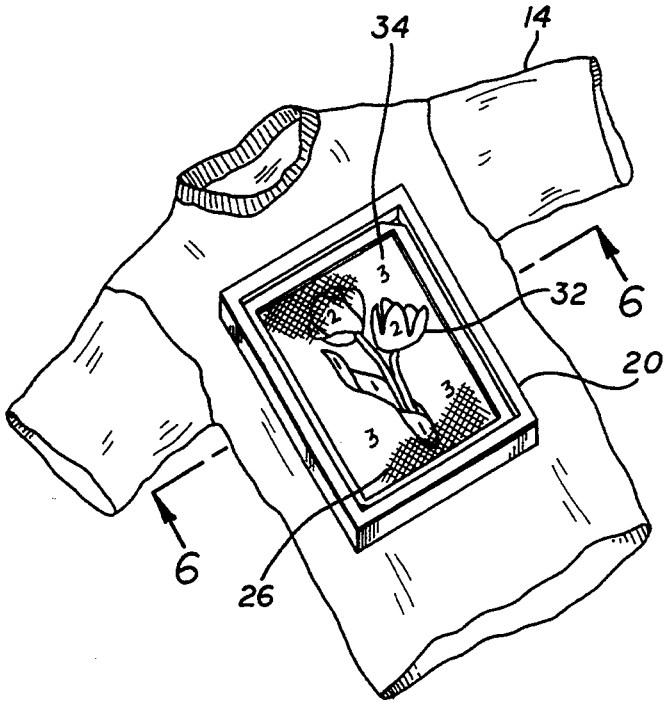
Figure 6:
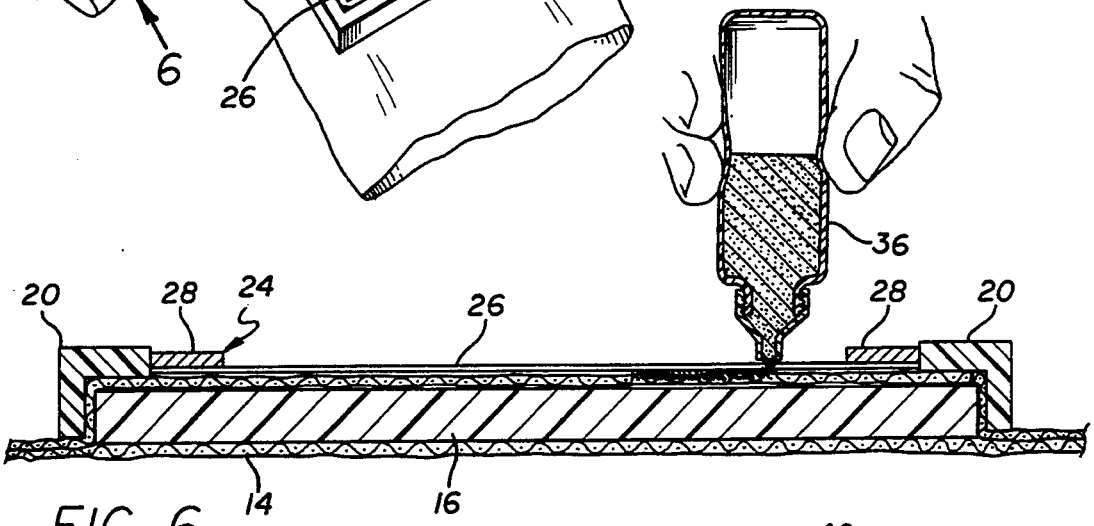

The screen pattern 24 is then placed into the bracket 20 immediately adjacent the framed portion of the shirt 14 which is, in effect, the painting surface. The screen portion 26 of the screen pattern 24 is a piece of fine thread, open weave silk screen type fabric that has a printed outline pattern 32 (in the form of two flowers) and printed color indicia 34 (in the form of the numbers "1", "2" and "3"). The screen 26 is stretched tightly and attached to a die cut cardboard or plastic outer frame 28. The edges of the outer frame 28 fit precisely inside the inner edge of the bracket 20. This prevents relative movement of the screen pattern 24 with respect to the underlying portion of the shirt 14 (FIGS. 4–6).

Next, utilizing either a fabric marker or a fine-tipped fabric paint bottle 36, a user simply draws on or paints the shirt 14 directly through the screen pattern 24. The printed outline pattern 32 indicates exactly where to paint, and the color indicia 34 indicates the colors to paint. The screen pattern 24 provides a durable surface to work on even when the user presses hard with the marker or paint bottle 36. As color flows from the marker or bottle 36, it passes through the screen portion 26 of the screen pattern 24 and is absorbed into the fabric of the shirt 14. This provides a mess-free working surface.

With reference to FIG. 7, after paint has been applied, the screen pattern 24 may be lifted from the shirt 14 and the bracket 20 to reveal the wearable art 12. If the user detects that an area needs additional painting, the screen pattern 24 is simply replaced within the bracket 20, and the painting is completed. The outer periphery of the frame 28 registers with inner periphery of the bracket 20 to ensure precise alignment of the screen pattern 24 over the previously painted areas of the shirt 14. After the design is fully filled in, the entire graphics system 10 is removed from the shirt 14.

A modified form of the invention is illustrated in FIG. 8. As shown, instead of using the bracket 20 which is pressed over the backing board 16 to frictionally engage a portion of the shirt 14, a pair of L-shaped registration tabs 38 are utilized. These registration tabs 38 are preferably positioned at opposite corners of the screen pattern 24, and are held in place by means of push pins 40. In this embodiment it is preferred that the backing board 16 be constructed of a thick rigid foam or fiber material which is pierceable. The push pins 40 extend through the registration tabs 38, the underlying portion of the shirt 14 and into the backing board 16. When the screen pattern 24 is in place between the registration tabs 38, relative movement between the underlying of the shirt 14 and the screen pattern 24 is prevented.

Apertures 42 are also provided in the outer frame 28 of the screen pattern 24, for anchoring the screen pattern directly to the backing board 16 with push pins if re-registration with the tabs 38 is not needed.

From the foregoing it is to be appreciated that the draw-through-pattern graphics system of the present invention, and its related method for applying a design to a substrate utilizes easy-to-produce components and may be readily understood and utilized by adults and youth alike. The graphics system of the present invention is particularly useful in connection with clothing items, and its construction minimizes the mess often associated with handicrafts utilizing fabric paints. Moreover, the graphics system 10 of the present invention permits a user to view the painted wearable art prior to disassembly of the graphics system, and proceed with confidence that the printed outline pattern 32 is precisely aligned with the wearable art 12 already applied to the clothing item 14.

Although two particular embodiments of the invention have been described in detail for purposes of illustration, various modifications of each may be made without departing from the spirit and scope of the invention. Accordingly, the invention is not to be limited, except as by the appended claims.

I claim:

1. A method for applying a design to a substrate, comprising the steps of:

placing the substrate over a backing board;

securing a bracket to the backing board and over the substrate in a manner preventing relative movement between the bracket and the substrate;

providing a screen pattern including an open mesh, inner paint-through screen supported about its periphery by an outer frame, the paint-through screen having an outline pattern applied thereto;

placing the screen pattern over the substrate and within the bracket; and painting the design onto the substrate through the screen pattern utilizing the outline pattern as a guide.

2. The method of claim 1, wherein the step of securing the bracket to the backing board, includes the step of clamping the substrate between the bracket and the backing board so as to lock together the backing board, a portion of the substrate overlying the backing board, and the bracket.

3. The method of claim 2, including the step of providing the bracket with dimensions to generally match an outer periphery of the backing board such that the step of securing the bracket to the backing board, includes the step of pressing the bracket over the backing board so as to frictionally capture a portion of the substrate about the outer periphery of the backing board.

4. The method of claim 1, wherein the step of placing the screen pattern over the substrate and within the bracket, includes the step of engaging edges of the screen pattern with the bracket to limit movement of the screen pattern relative to the substrate.

5. The method of claim 4, wherein outer peripheral edges of the screen pattern are dimensioned to match inner peripheral edges of the bracket such that the step of placing the screen pattern within the bracket, includes the step of placing the screen pattern in register within the bracket.

6. The method of claim 1, wherein the step of securing the bracket to the backing board, includes the step of pinning the bracket to the backing board.

7. The method of claim 6, wherein the bracket comprises a plurality of tabs which are pinned to the backing board over the substrate such that the step of placing the screen pattern over the substrate and within the bracket, includes the step of engaging edge portions of the screen pattern with the tabs to limit movement of the screen pattern relative to the substrate.

8. The method of claim 1, wherein the step of painting the design onto the substrate through the screen pattern, includes the step of utilizing a fabric paint bottle to apply paint to the substrate through the paint-through screen.

9. The method of claim 8, wherein the step of painting the design onto the substrate through the screen pattern, includes the step of painting in accordance with the outline pattern.

10. The method of claim 9, including the step of providing color indicia for the design on the screen pattern, and wherein the step of painting the design onto the substrate through the screen pattern, includes the step of painting in accordance with the color indicia.

11. The method of claim 1, including the steps of removing the screen pattern from the substrate to check progress of the painting of the design onto the substrate through the screen pattern, and replacing the screen pattern over the substrate within the bracket and further painting of the design onto the substrate through the screen pattern.

12. The method of claim 11, including the step of providing the screen pattern with notches which permit access to a space between the screen pattern and the bracket to facilitate removal of the screen pattern from the bracket during the removing step.

13. The method of claim 11, wherein the substrate is a portion of a clothing item, and wherein the step of placing the substrate over the backing board, includes the step of placing the backing board within the clothing item such that the step of securing the bracket to the backing board over the substrate, includes the step of stretching the portion of the clothing item over the backing board and clamping it between the bracket and the backing board.

14. A hand portable draw-through-pattern graphics system, comprising:

a backing board having a generally planar supporting surface;

a substrate draped over the supporting surface;

a screen pattern disposed adjacent to the substrate opposite the supporting surface, the screen pattern including an open mesh inner paint-through screen supported about its periphery by an outer frame, the paint-through screen having an outline pattern for a design applied thereto;

means for clamping the substrate to the backing board, and for engaging edges of the screen pattern to limit movement of the screen pattern relative to the substrate; and means for painting the design onto the substrate through the screen pattern utilizing the outline pattern as a guide.

15. The graphics system of claim 14, including color indicia for the design applied to the screen pattern.

16. The graphics system of claim 14, wherein the clamping means comprises a bracket having an inner periphery generally corresponding with an outer periphery of the backing board, wherein the bracket is pressed over the backing board to frictionally capture the substrate between the bracket and the outer periphery of the backing board.

17. The graphics system of claim 16, wherein the bracket includes an inner peripheral portion dimensioned to correspond to the dimensions of the screen pattern outer frame.

18. The graphics system of claim 17, wherein the screen pattern outer frame includes notches which permit access to a space between the screen pattern and the bracket to facilitate removal of the screen pattern from the bracket.

19. The graphics system of claim 14, wherein the clamping means comprises a plurality of registration tabs disposed over the substrate opposite the rigid backing board, and push pins extending through the registration tabs and the substrate into the backing board.

20. The graphics system of claim 19, wherein the backing board comprises a rigid yet pierceable foam material.

21. A process for creating wearable art on an item of clothing, comprising the steps of:

placing a backing board adjacent to the clothing item so that the backing board underlies a portion of the clothing item to which the wearable art is to be applied;

providing a rigid bracket dimensioned to generally match an outer periphery of the backing board;

securing the bracket to the backing board and over the portion of the clothing item in a manner preventing relative movement between the bracket and the portion of the clothing item, the securing step including the steps of pressing the bracket over the backing board so as to frictionally capture the portion of the clothing item about the outer periphery of the backing board, and stretching the portion of the clothing item over the backing board;

providing a screen pattern having an open mesh inner paint-through screen and an outer frame having outer peripheral dimensions which match an inner periphery of the bracket, the paint-through screen having an outline pattern and color indicia applied thereto;

placing the screen pattern over the portion of the clothing item and in register within the bracket; and painting a design onto the clothing item through the screen pattern utilizing the outline pattern and the color indicia as a guide.

22. The method of claim 21, including the steps of removing the screen pattern from the clothing item to check progress of the painting of the design onto the portion of the clothing item through the screen pattern, replacing the screen pattern over the clothing item within the bracket, and further painting of the design onto the clothing item through the screen pattern.

* * * * *